US011679598B2

(12) United States Patent
OHara

(10) Patent No.: US 11,679,598 B2
(45) Date of Patent: Jun. 20, 2023

(54) PRINTING APPARATUS AND PRINTING METHOD

(71) Applicant: SEIKO EPSON CORPORATION, Tokyo (JP)

(72) Inventor: Eiichi OHara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/388,051

(22) Filed: Jul. 29, 2021

(65) Prior Publication Data

US 2022/0032668 A1 Feb. 3, 2022

(30) Foreign Application Priority Data

Jul. 31, 2020 (JP) ..... 2020-130101

(51) Int. Cl.
*B41J 29/393* (2006.01)
*B41J 2/21* (2006.01)

(52) U.S. Cl.
CPC ..... *B41J 2/2142* (2013.01); *B41J 2029/3935* (2013.01)

(58) Field of Classification Search
CPC ..... B41J 2/2142; B41J 2029/3935
See application file for complete search history.

(56) References Cited

U.S. PATENT DOCUMENTS

2005/0030331 A1* 2/2005 Komatsu ..... B41J 2/04558 347/19
2007/0040878 A1 2/2007 Ikefuji et al.
2016/0279992 A1* 9/2016 Aoi ..... B41J 2/2142

FOREIGN PATENT DOCUMENTS

JP 2007-054970 A 3/2007
JP 2016-198899 A 12/2016
JP 2016-221835 A 12/2016

* cited by examiner

*Primary Examiner* — Julian D Huffman
(74) *Attorney, Agent, or Firm* — Global IP Counselors, LLP

(57) ABSTRACT

A printing apparatus includes a transport unit, a printing head, and a control unit that prints, on a printing medium, a test pattern for inspecting a state of ink discharge by a nozzles. The test pattern includes a first pattern element group in which a plurality of pattern elements to be printed by the nozzles are arranged in the transport direction, and a second pattern element group in which a plurality of pattern elements to be printed by the nozzles are arranged in the transport direction. After the control unit causes the transport unit to transport, by a distance equal to or greater than a nozzle pitch, the printing medium printed with the first pattern element group by causing the nozzles to discharge the ink, the control unit prints the second pattern element group on the printing medium by causing the nozzles used to print the first pattern element group to discharge the ink.

5 Claims, 8 Drawing Sheets

PRINTING APPARATUS AND PRINTING METHOD

The present application is based on, and claims priority from JP Application Ser. No. 2020-130101, filed Jul. 31, 2020, the disclosure of which is hereby incorporated by reference herein in its entirety.

BACKGROUND

1. Technical Field

The present disclosure relates to a printing apparatus and a printing method.

2. Related Art

Technology has been disclosed of an inkjet type printing apparatus in which a test pattern is recorded on a print sheet by a recording head, the test pattern is read by a scanner, interpolation processing is performed on read data, and a nozzle abnormality is determined on the basis of the interpolated read data (see JP-A-2007-54970).

However, when the scanner reads a printing medium on which the test pattern is printed, a portion of the read data of the test pattern may become distorted due to stretching or contraction or the like caused by the occurrence of a sudden vibration or external force. It is difficult to inspect whether or not printing by each of the nozzles is normal using the portion of the read data that is distorted. Therefore, there is a need for a test pattern with which it is easy to detect distortion of the read data as described above.

SUMMARY

A printing apparatus includes a transport unit configured to transport a printing medium in a transport direction, a printing head including a plurality of nozzles configured to discharge ink, and a control unit configured to control the transport unit and the printing head to print, on the printing medium, a test pattern for inspecting a state of ink discharge by the plurality of nozzles. The test pattern includes a first pattern element group in which a plurality of pattern elements to be printed by the plurality of nozzles are arranged in the transport direction, and a second pattern element group in which a plurality of pattern elements to be printed by the plurality of nozzles are arranged in the transport direction. After the control unit causes the transport unit to transport, by a distance equal to or greater than a nozzle pitch, the printing medium printed with the first pattern element group by causing the plurality of nozzles to discharge the ink, the control unit prints the second pattern element group on the printing medium by causing the plurality of nozzles used to print the first pattern element group to discharge the ink, the nozzle pitch being an interval, in the transport direction, between the plurality of nozzles.

A printing method includes a printing step of printing a test pattern on a printing medium, for inspecting, using a printing head including a plurality of nozzles configured to discharge ink, a state of ink discharge by the plurality of nozzles. The test pattern includes a first pattern element group in which a plurality of pattern elements to be printed by the plurality of nozzles are arranged in a transport direction of the printing medium, and a second pattern element group in which a plurality of pattern elements to be printed by the plurality of nozzles are arranged in the transport direction. In the printing step, after transporting, by a distance equal to or greater than a nozzle pitch, the printing medium printed with the first pattern element group by causing the plurality of nozzles to discharge the ink, the second pattern element group is printed on the printing medium by causing the plurality of nozzles used to print the first pattern element group to discharge the ink, the nozzle pitch being an interval, in the transport direction, between the plurality of nozzles.

DESCRIPTION OF EXEMPLARY EMBODIMENTS

Embodiments of the present disclosure will be described below with reference to the accompanying drawings. Note that each of the drawings is merely illustrative for describing the embodiment. Since the drawings are illustrative, proportions and shapes may not be precise, match each other, or some may be omitted.

1. Apparatus Configuration

Figure 1:
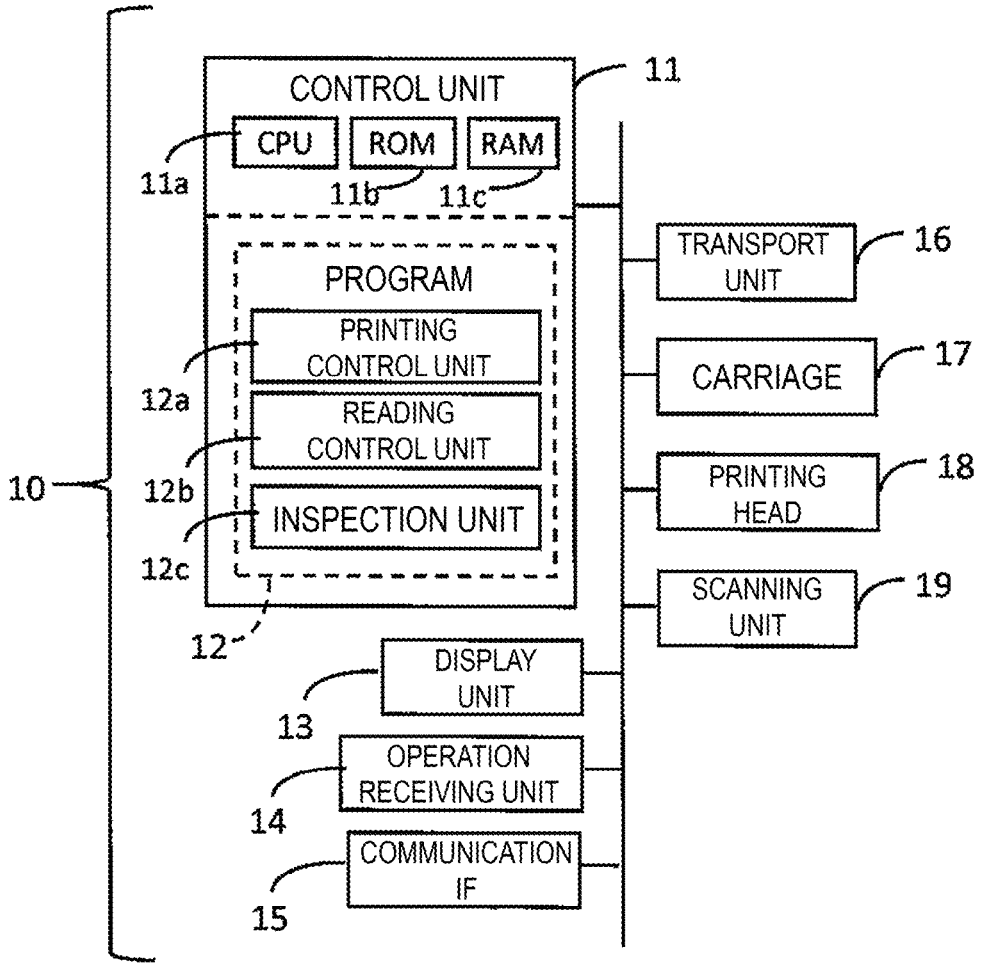
FIG. 1 is a block diagram illustrating an apparatus configuration in a simplified manner.

FIG. 1 illustrates a configuration of a printing apparatus 10 according to the embodiment, in a simplified manner.

The printing apparatus 10 is provided with a control unit 11, a display unit 13, an operation receiving unit 14, a communication IF 15, a transport unit 16, a carriage 17, a printing head 18, a reading unit 19, and the like. IF is an abbreviation for interface. The control unit 11 is configured to include one or more ICs including a CPU 11*a* as a processor, a ROM 11*b*, a RAM 11*c*, and the like, another non-volatile memory, and the like.

In the control unit 11, the processor, that is, the CPU 11*a* executes arithmetic processing in accordance with one or more programs 12 stored in the ROM 11*b*, the other memory, or the like, using the RAM 11*c* or the like as a work area, to realize various functions such as a printing control unit 12*a*, a reading control unit 12*b*, an inspection unit 12*c*, and the like. Note that the processor is not limited to the single CPU, and a configuration may be adopted in which the processing is performed by a hardware circuit such as a plurality of CPUs, an ASIC, or the like, or a configuration may be adopted in which the CPU and the hardware circuit work in concert to perform the processing.

The display unit 13 is a device for displaying visual information, and is configured, for example, by a liquid crystal display, an organic EL display, or the like. The display unit 13 may be configured to include a display and a drive circuit for driving the display. The operation receiving unit 14 is a device for receiving an operation by a user, and is realized, for example, by a physical button, a touch panel, a mouse, a keyboard, or the like. Of course, the touch panel may be realized as a function of the display unit 13.

The display unit 13 and the operation receiving unit 14 may be part of the configuration of the printing apparatus 10, or may be peripheral devices externally coupled to the printing apparatus 10. The communication IF 15 is a generic term for one or a plurality of IFs for coupling the printing apparatus 10 with the outside in a wired or wireless manner, in accordance with a prescribed communication protocol including a known communication standard provide.

The transport unit 16 is a device for transporting the printing medium, and includes a roller, a motor for rotating the roller, and the like. The printing head 18 ejects ink from nozzles onto the printing medium, using an inkjet method, to perform printing. The reading unit 19 is a device for reading a printing result on the printing medium. The reading unit 19 is also referred to as a scanner. However, the printing apparatus 10 may have a configuration that does not include the reading unit 19.

Figure 2:
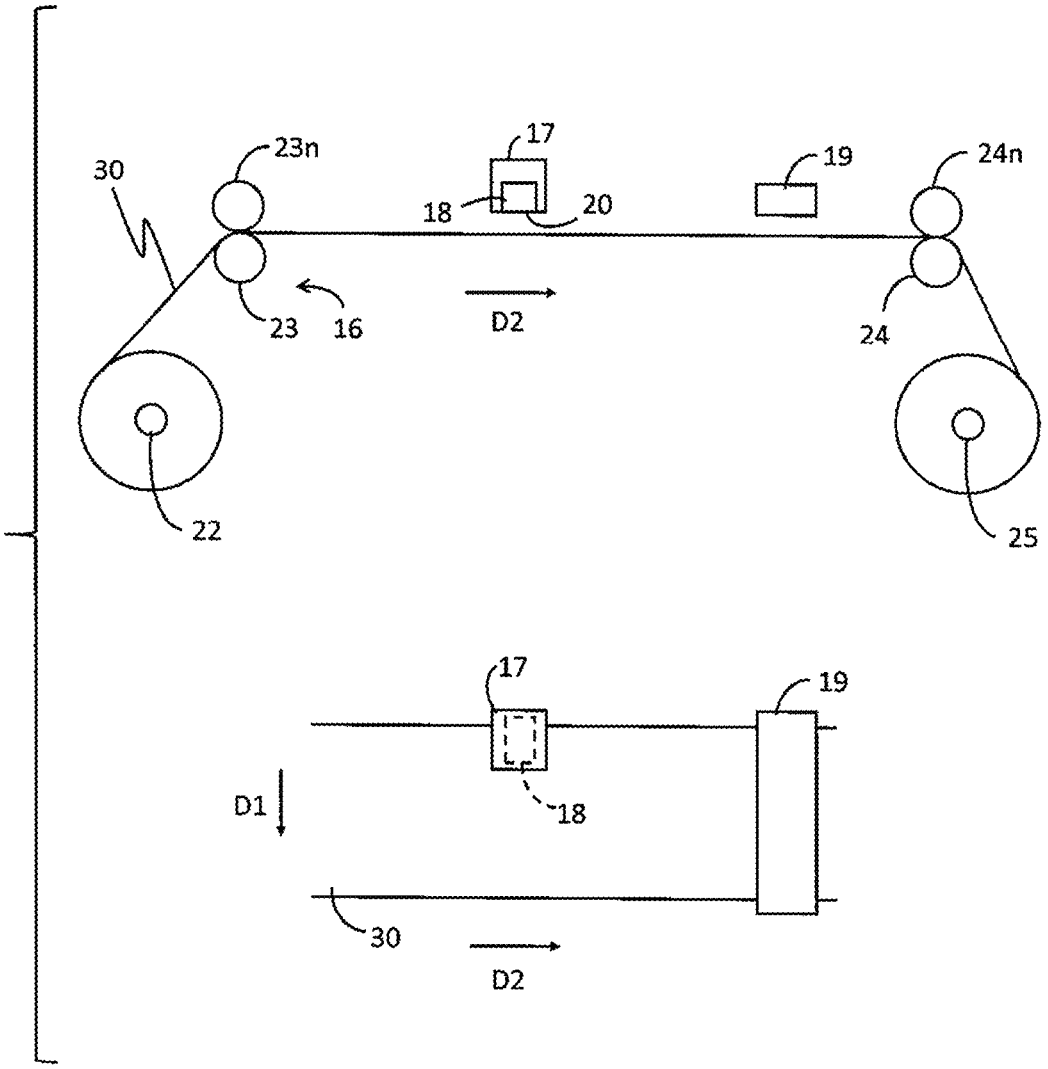
FIG. 2 is a diagram illustrating a specific example of a configuration including a printing head and a transport unit.
Figure 3:
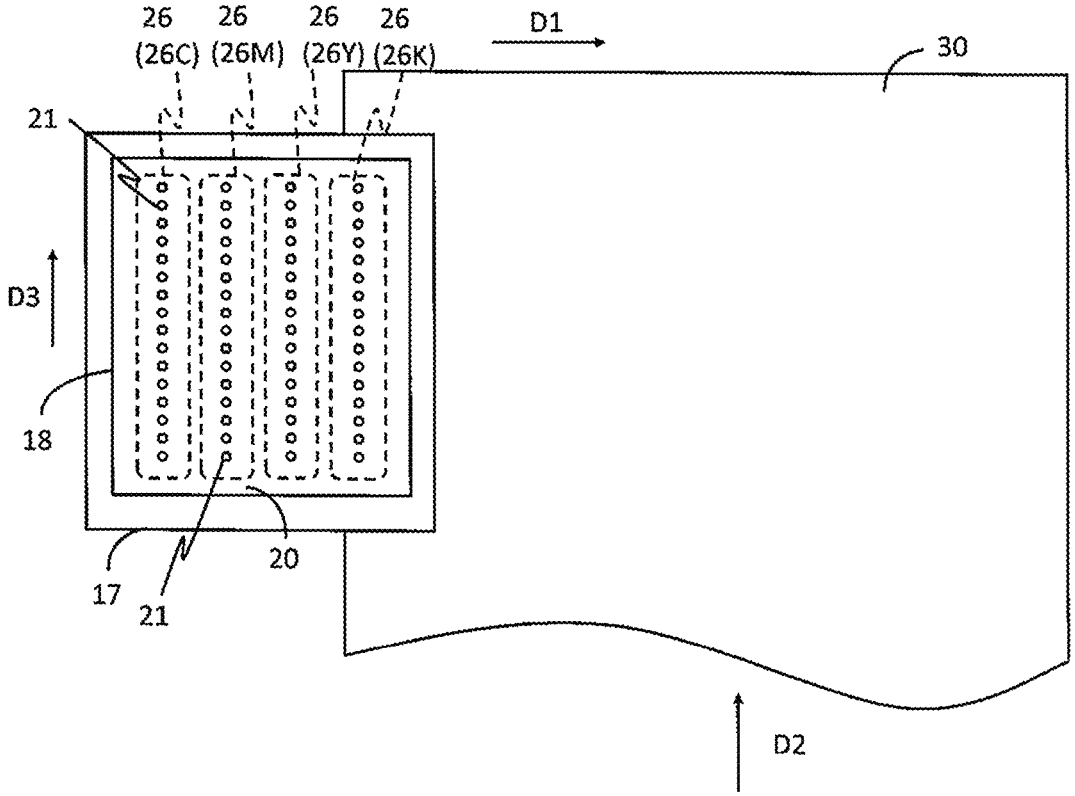
FIG. 3 is a diagram illustrating a relationship between a printing medium and the printing head, as seen from above.

The carriage 17 is a mechanism capable of reciprocating along a predetermined direction as a result of receiving power from a carriage motor (not illustrated). The predetermined direction in which the carriage 17 moves is referred to as a main scanning direction. As illustrated in FIG. 2 and FIG. 3, the printing head 18 is mounted on the carriage 17.

The configuration of the printing apparatus 10 illustrated in FIG. 1 may be realized by a single printer, or may be realized by a plurality of communicatively coupled devices.

In other words, the printing apparatus 10 may be the printing system 10 in actuality. The printing system 10 includes, for example, an information processing device that functions as the control unit 11, and a printer including the transport unit 16, the carriage 17, the printing head 18, and further, the reading unit 19. A printing method according to the embodiment is realized in this way by the printing apparatus 10 or the printing system 10.

Further, a portion of the control unit 11 that functions as the printing control unit 12*a* and a portion of the control unit 11 that functions as the reading control unit 12*b* and the inspection unit 12*c* may be separate information processing devices.

FIG. 2 illustrates a specific example of a configuration mainly including the printing head 18 and the transport unit 16, which are parts of the printing apparatus 10. In an upper section of FIG. 2, the specific example is illustrated as viewed in a direction orthogonal to a transport direction D2 of a printing medium 30, and in a lower section of FIG. 2, the specific example is illustrated as viewed from above.

The transport unit 16 is provided with a feeding shaft 22 upstream in the transport direction, and a winding shaft 25 downstream in the transport direction. Upstream and downstream in the transport direction are simply denoted using upstream and downstream. The long printing medium 30 wound in a roll shape around the feeding shaft 22 and the winding shaft 25 is stretched along the transport direction D2. The printing medium 30 is transported in the transport direction D2. The printing medium 30 may be a paper sheet or may be a medium made from a material other than paper.

In the example illustrated in FIG. 2, the printing medium 30 wound around the feeding shaft 22 is fed downstream by the feeding shaft 22 rotating in the clockwise direction. A front driving roller 23 is provided at a position downstream of the feeding shaft 22, and a rear driving roller 24 is provided at a position upstream of the winding shaft 25. By rotating in the clockwise direction, the front driving roller 23 transports downstream the printing medium 30 fed out from the feeding unit 22. A nip roller 23*n* is provided with respect to the front driving roller 23. The nip roller 23*n* comes into contact with the printing medium 30 so as to clamp the printing medium 30 between the nip roller 23*n* and the front driving roller 23.

By rotating in the clockwise direction, the rear driving roller 24 transports further downstream the printing medium 30 transported downstream by the front driving roller 23. Note that a nip roller 24*n* is provided with respect to the rear driving roller 24. The nip roller 24*n* comes into contact with the printing medium 30 so as to clamp the printing medium 30 between the nip roller 24*n* and the rear driving roller 24.

The printing head 18 that discharges ink onto the printing medium 30 from above is disposed between the front driving roller 23 and the rear driving roller 24. As illustrated in FIG. 2, the printing head 18 is mounted on the carriage 17. The printing head 18 is capable of discharging a plurality of colors of ink, such as cyan (C), magenta (M), yellow (Y), and black (K), for example.

Each of the nozzles of the printing head 18 is open in a nozzle surface 20, of the printing head 18, facing the printing medium 30, and the printing head 18 discharges or does not discharge the ink from the nozzles on the basis of print data. The ink discharged by the nozzle is also referred to as an ink droplet, or as a dot. The printing head 18 may also be referred to as a print head, an inkjet head, a liquid discharging head, a recording head, and the like.

As a result of the winding shaft 25 rotating in the clockwise direction, the winding shaft 25 takes up the printing medium 30 after printing that is transported by the rear driving roller 24.

The feeding shaft 22, the winding shaft 25, each of the rollers, the motor (not illustrated) for rotating these members as appropriate, and the like are a specific example of the transport unit 16 that transports the printing medium 30. A number and arrangement of the rollers provided along the transport path for transporting the printing medium 30 is not limited to the mode illustrated in FIG. 2. Further, the colors of the inks discharged by the printing head 18 are not limited to the colors described above. It goes without saying that a flat platen or the like, which supports, from below, the printing medium 30 that receives the ink discharge from the printing head 18, may be provided between the front driving roller 23 and the rear driving roller 24. Further, the portion of the printing medium 30 on which the printing by the printing head 18 has been performed need not necessarily be wound into the roll shape by the winding shaft 25, and may be cut away from the printing medium 30 that is upstream of the printed portion, using a cutter (not illustrated).

In the example illustrated in FIG. 2, the reading unit 19 is provided at a position downstream of the carriage 17 and the printing head 18 and upstream of the rear driving roller 24. Using an image sensor, the reading unit 19 optically reads the printing medium 30 on which the printing has been performed by the printing head 18, and outputs image data as a reading result. In the example illustrated in FIG. 2, the reading unit 19 extends in a main scanning direction D1 that intersects the transport direction D2 and has a length capable of covering the width of the printing medium 30, and reads the printing medium 30 transported by the transport unit 16 in a stationary state.

FIG. 3 illustrates a relationship between the printing medium 30 and the printing head 18 in a simplified manner, as seen from above. The printing head 18 mounted on the carriage 17 moves, together with the carriage 17, from one end in the main scanning direction D1 to the other end (a forward movement) and from the other end to the one end (a return movement). The main scanning direction D1 and the transport direction D2 intersect each other. The intersection may be understood to be orthogonal. Thus, FIG. 2 illustrates the printing head 18 and the like from a perspective facing in parallel to the main scanning direction D1. However, due to various errors in the printer as a manufactured product, for example, the main scanning direction D1 and the transport direction D2 may not be precisely orthogonal. The transport direction is also referred to as a sub scanning direction.

In FIG. 3, an example is illustrated of an array of nozzles 21 in the nozzle surface 20. Each of small circles in the nozzle surface 20 is the nozzle 21. The printing head 18 is provided with a plurality of nozzle rows 26 in a configuration in which each color of the inks is discharged from the nozzles 21 after being supplied from a liquid holding unit (not illustrated) that is referred to as an ink cartridge, an ink tank, or the like. The nozzle row 26 including the nozzles 21 that discharge the C ink is also described as a nozzle row 26C. Similarly, the nozzle row 26 including the nozzles 21 that discharge the M ink is also described as a nozzle row 26M, the nozzle row 26 including the nozzles 21 that discharge the Y ink is also described as a nozzle row 26Y, and the nozzle row 26 including the nozzles 21 that discharge the K ink is also described as a nozzle row 26K. The nozzle rows 26C, 26M, 26Y, and 26K are aligned along the main scanning direction D1.

Each of the nozzle rows 26 is configured by the plurality of nozzles 21 for which a nozzle pitch, which is an interval between the nozzles 21 in the transport direction D2, is constant or substantially constant. The direction in which the plurality of nozzles 21 configuring the nozzle row 26 are aligned is referred to as a nozzle row direction D3. In the example illustrated in FIG. 3, the nozzle row direction D3 is parallel with the transport direction D2. In the configuration in which the nozzle row direction D3 is parallel with the transport direction D2, the nozzle row direction D3 and the main scanning direction D1 are orthogonal. However, the nozzle row direction D3 need not necessarily be parallel with the transport direction D2, and a configuration may be adopted in which the nozzle row direction D3 obliquely intersects the main scanning direction D1.

The respective positions of the nozzle rows 26C, 26M, 26Y, and 26K in the transport direction D2 match each other. The printing apparatus 10 prints an image on the printing medium 30 by performing a combination of transport of the printing medium 30 in the transport direction D2, and ink discharge by the printing head 18 in accordance with movement of the carriage 17 along the main scanning direction D1. The operation of the ink discharge by the printing head 18 in accordance with the forward movement and the return movement of the carriage 17 is referred to as a "scan" or a "pass".

2. Test Pattern Printing

Figure 4:
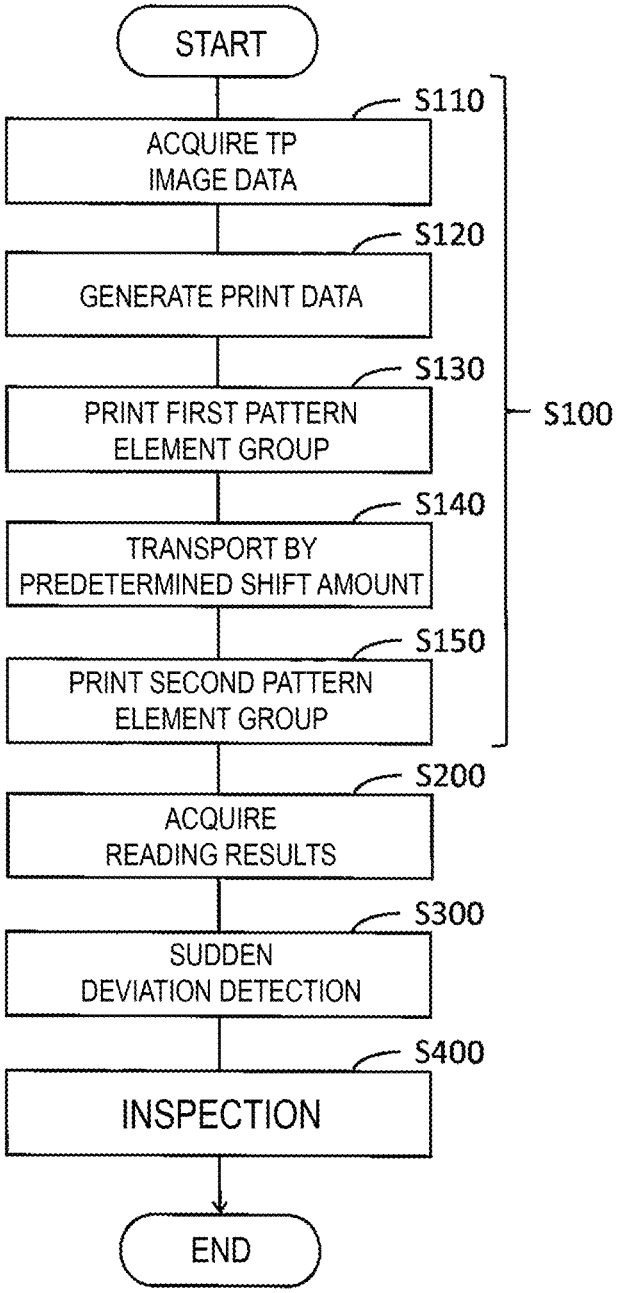
FIG. 4 is a flowchart illustrating a flow from TP printing to an inspection of nozzles.

FIG. 4 illustrates, using a flowchart, a flow executed by the control unit 11 in accordance with the program 12, from printing of a TP to an inspection of the nozzles 21 on the basis of the TP. TP is an abbreviation for test pattern. In overview, the flowchart includes TP printing processing (step S100), acquisition of a reading result of the printed TP (step S200), detection of sudden deviation based on the reading result of the TP (step S300), and inspection of the nozzles 21 based on the reading result of the TP (step S400). Step S100 corresponds to a TP printing step. In FIG. 4, step S100 is illustrated in detail while being divided into steps S110 to S150.

At step S110, the printing control unit 12*a* acquires TP image data, which is image data representing the TP, from a storage source such as a predetermined memory or storage device with which the control unit 11 can communicate. The TP image data is, for example, image data in a bitmap format defining the color of each of pixels in a predetermined color system. As the color system referred to here, for example, there are various color systems, such as an RGB (red, green, blue) color system, a CMYK color system, or the like.

At step S120, the printing control unit 12*a* generates, from the TP image data, the print data for printing the TP. The printing control unit 12*a* generates the print data that prescribes ink discharge (dot on) or ink non-discharge (dot off) for each of the pixels and each of the ink colors, by performing predetermined image processing, such as color conversion processing and halftone processing, on the TP image data. As illustrated in FIG. 3, assuming that the printing head 18 uses the four colors of ink of CMYK, at step S120, the printing control unit 12*a* generates the print data prescribing the dot on and off for each of the pixels and for each of CMYK, based on the TP image data.

The TP of the embodiment includes a "first pattern element group" in which a plurality of "pattern elements" printed by the nozzles 21 are arranged in the transport direction D2, and a "second pattern element group" in which a plurality of such pattern elements are arranged in the transport direction D2. One pattern element is printed by one of the nozzles 21. Further, the first pattern element group and the second pattern element group are printed on the printing medium 30 in a positional relationship in which, in the transport direction D2, they are shifted with respect to each other by a distance equal to or greater than the nozzle pitch.

Steps S130 to S150 will be described in detail with reference to FIG. 5.

Figure 5:
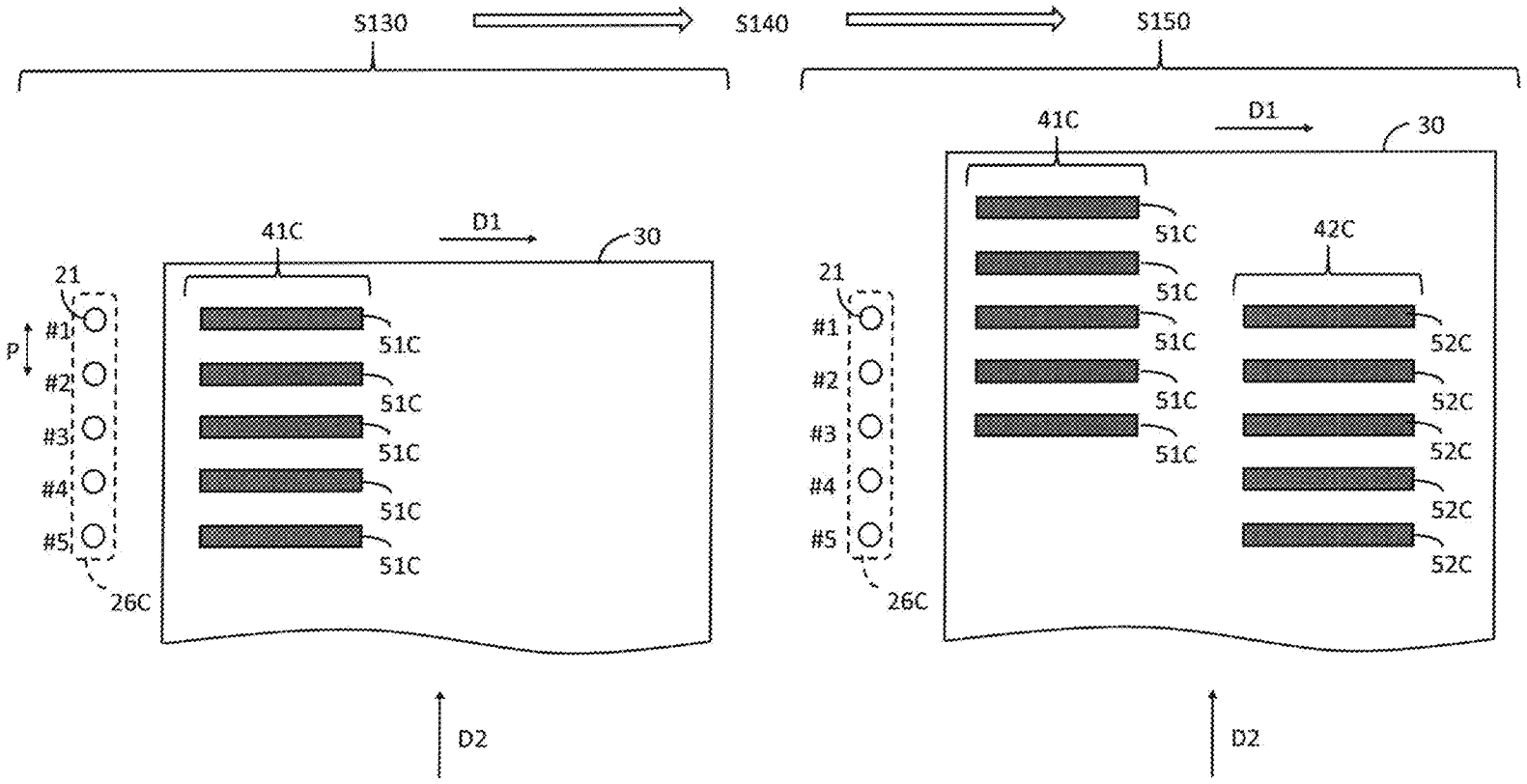
FIG. 5 is a diagram illustrating a state in which a TP is printed on the printing medium in accordance with steps S130 to S150.

FIG. 5 illustrates a state in which the TP is printed on the printing medium in accordance with steps S130 to S150.

At step S130, by controlling the movement of the carriage 17 along the main scanning direction D1 and the ink discharge by the printing head 18, the printing control unit 12*a* prints the first pattern element group on the printing medium 30 on the basis of the print data. On the left in FIG. 5, a portion of the nozzle row 26C used for printing a first pattern element group 41C and a portion of the printing medium 30 are illustrated, and, furthermore, the state in which the first pattern element group 41C has been printed on the printing medium 30 at step S130 is illustrated. The C ink is discharged from each of the nozzles 21 of the nozzle row 26C by a pass of the printing head 18, and a plurality of pattern elements 51C are printed. The first pattern element group 41C is configured by the plurality of pattern elements 51C that are arranged side by side in the transport direction D2.

Each of the pattern elements 51C is a ruled line parallel with the main scanning direction D1, formed by dots of the C ink discharged by one of the nozzles 21 in the nozzle row 26C. In FIG. 5, a reference sign"P" denotes the nozzle pitch. In other words, the plurality of pattern elements 51C are ideally printed at the same interval as the nozzle pitch P in the transport direction D2. Further, in FIG. 5, in order to distinguish the nozzles 21 in the nozzle row 26C, each of the nozzles 21 is assigned a nozzle number for convenience. Specifically, the nozzles 21 are numbered sequentially from downstream to upstream as nozzles #1, #2, #3 and so on. In FIG. 5, due to limitations of space on paper, five of the nozzles 21 having the nozzle numbers #1 to #5 are illustrated, but of course, the nozzle row 26C is configured by more of the nozzles 21, and each of the nozzles 21 of the nozzle row 26C prints the pattern element 51C. Each of the pattern elements 51C configuring the first pattern element group 41C may also be referred to as a "first pattern element".

After printing the first pattern element group at step S130, at step S140, the printing control unit 12*a* controls the transport unit 16 to transport the printing medium 30 by a predetermined shift amount. Here, the predetermined shift amount is a distance that is twice the nozzle pitch P. In other words, the printing medium 30 is transported downstream by the nozzle pitch P×2. As a result of such transportation, as illustrated in FIG. 5, at step S130, the pattern element 51C printed by the nozzle 21 having the nozzle number #3 matches or nearly matches the position of the nozzle 21 of the nozzle number #1 in the transport direction D2.

After step S140, at step S150, by controlling the movement of the carriage 17 along the main scanning direction D1 and the ink discharge by the printing head 18, the printing control unit 12*a* prints the second pattern element group on the printing medium 30 on the basis of the print data. On the right in FIG. 5, a portion of the nozzle row 26C used for printing a first pattern element group 42C and a portion of the printing medium 30 are illustrated, and, furthermore, the state in which the second pattern element group 42C has been printed on the printing medium 30 at step S150 is illustrated. In other words, after the first pattern element group 41C is printed by the nozzle row 26C, the second pattern element group 42C is printed by the same nozzle row 26C after the transport by the predetermined shift amount. The C ink is discharged from each of the nozzles 21 of the nozzle row 26C by a pass of the printing head 18, and a plurality of pattern elements 52C are printed. The second pattern element group 42C is configured by the plurality of pattern elements 52C that are arranged side by side in the transport direction D2.

Similarly to the pattern element 51C, each of the pattern elements 52C is also a ruled line parallel with the main scanning direction D1, formed by dots of the C ink discharged by one of the nozzles 21 in the nozzle row 26C. As with the relationship between the pattern elements 51C, the plurality of pattern elements 52C are ideally printed at the same interval as the nozzle pitch P in the transport direction D2. The pattern element 52C configuring the second pattern element group 42C may also be referred to as a "second pattern element".

As a result of printing the second pattern element group 42C at step S150, as illustrated in FIG. 5, the pattern element 52C printed by the nozzle 21 having the nozzle number #1 matches or nearly matches the position, in the transport direction D2, of the pattern element 51C printed by the nozzle 21 having the nozzle number #3 at step S130.

As described above, the TP including the first pattern element group and the second pattern element group is printed on the printing medium 30. Of course, the nozzle rows 26M, 26Y, and 26K other than the nozzle row 26C also respectively print the first pattern element group at step S130, and respectively print the second pattern element group at step S150.

Figure 6:
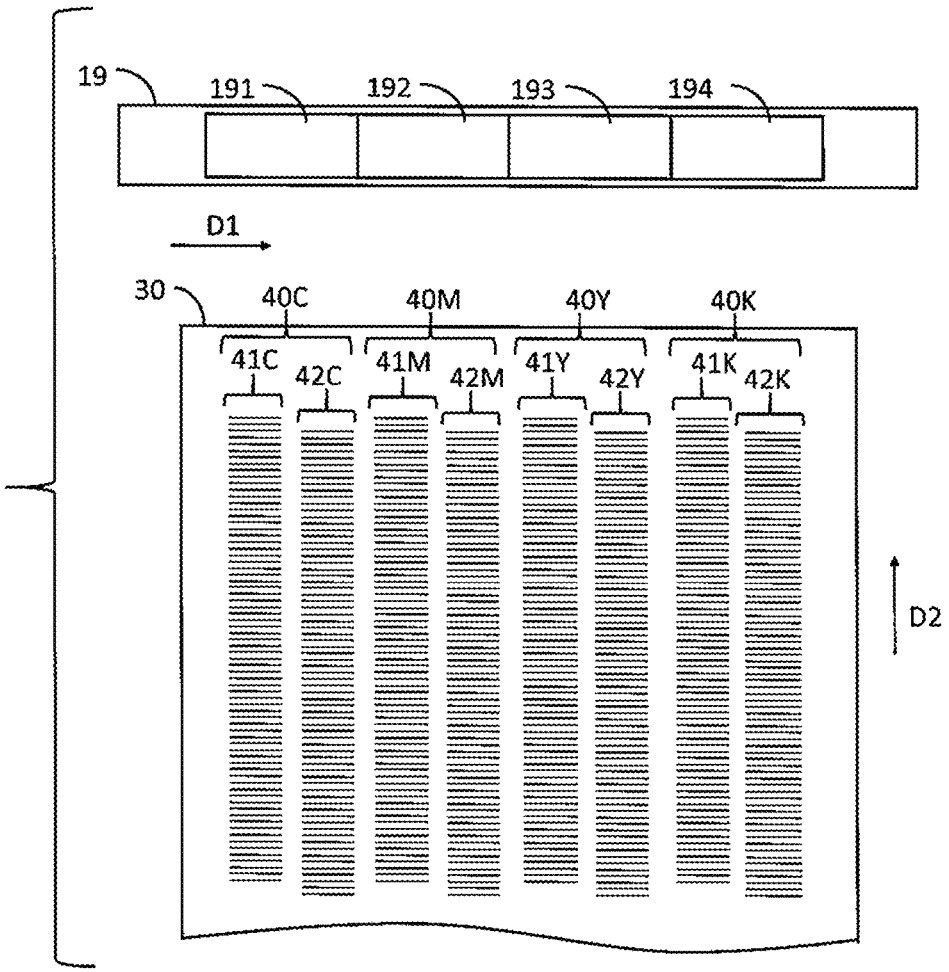
FIG. 6 is a diagram illustrating the printing medium or the like on which the TPs for each of ink colors are printed.

FIG. 6 illustrates the printing medium 30 on which TPs 40C, 40M, 40Y, and 40K are printed as a result of step S100. The TP 40C is configured by the first pattern element group 41C and the second pattern element group 42C printed by each of the nozzles 21 of the nozzle row 26C discharging the C ink, as described with reference to FIG. 5. Similarly, the TP 40M is configured by a first pattern element group 41M and a second pattern element group 42M printed by each of the nozzles 21 of the nozzle row 26M discharging the M ink. The TP 40Y is configured by a first pattern element group 41Y and a second pattern element group 42Y printed by each of the nozzles 21 of the nozzle row 26Y discharging the Y ink. The TP 40K is configured by a first pattern element group 41K and a second pattern element group 42K printed by each of the nozzles 21 of the nozzle row 26K discharging the K ink.

In other words, at step S130, the first pattern element 41C, the first pattern element 41M, the first pattern element 41Y, and the first pattern element 41K are printed by the pass of the printing head 18. Then, the second pattern element group 42C, the second pattern element group 42M, the second pattern element group 42Y, and the second pattern element 42K are printed at step S150 by the pass of the printing head 18.

As illustrated in FIG. 5 and FIG. 6, the first pattern element group and the second pattern element group configuring one of the TPs, that is, the TP of one of the colors, are disposed at adjacent positions in the main scanning direction D1. For example, in the main scanning direction D1, the TP of another color is not printed between the first pattern element group 41C and the second pattern element group 42C.

3. Processing after Printing Test Pattern

At step S200, the reading control unit 12*b* controls the reading unit 19 to read the printing medium 30 on which the TP has been printed at step S100, and acquires reading image data that is image data from the reading unit 19 as a reading result. It goes without saying that the transport unit 16 performs the transport necessary for the reading unit 19 to read the printing medium 30 after the printing.

In FIG. 6, the reading unit 19 is illustrated downstream of the printing medium 30. When the printing medium 30 transported downstream by the transport unit 16 passes below the reading unit 19, the printing medium 30 is read by the reading unit 19. In the example illustrated in FIG. 6, the reading unit 19 is configured by a plurality of sensor chips 191, 192, 193, and 194 being coupled in the main scanning direction D1. Each of the plurality of sensor chips 191, 192, 193, and 194 includes an image sensor, and reads a predetermined range of the transported printing medium 30.

Note that, at step S200, it is sufficient that the reading result of the printing medium 30 on which the TP has been printed can be acquired. Thus, the user may cause an external scanner to read the printing medium 30 on which the TP has been printed, and the printing apparatus 10 may acquire read image data from the scanner, via the communication IF 15.

At step S300, the inspection unit 12*c* performs detection of a "sudden deviation," on the basis of the read image data acquired at step S200. When the printing medium 30 printed with the TP is read by the reading unit 19 or the scanner, the sudden unexpected shift is a stretching or contraction distortion or the like that occurs in a portion of the read image data as a result of a sudden vibration or external force occurring with respect to the printing medium 30, the reading unit 19, or the like. The sudden vibration and external force may occur, for example, as a result of the user touching or walking close to the printing apparatus 10 or the scanner during a reading period of the printing medium 30, or may be caused by the shape of the transport path of the printing medium 30, or the like. Step S300 is performed in order that, in the inspection at the subsequent step S400, the sudden deviation is not confused with the positional deviation of the pattern elements caused by an abnormality of the nozzles 21.

Figure 7:
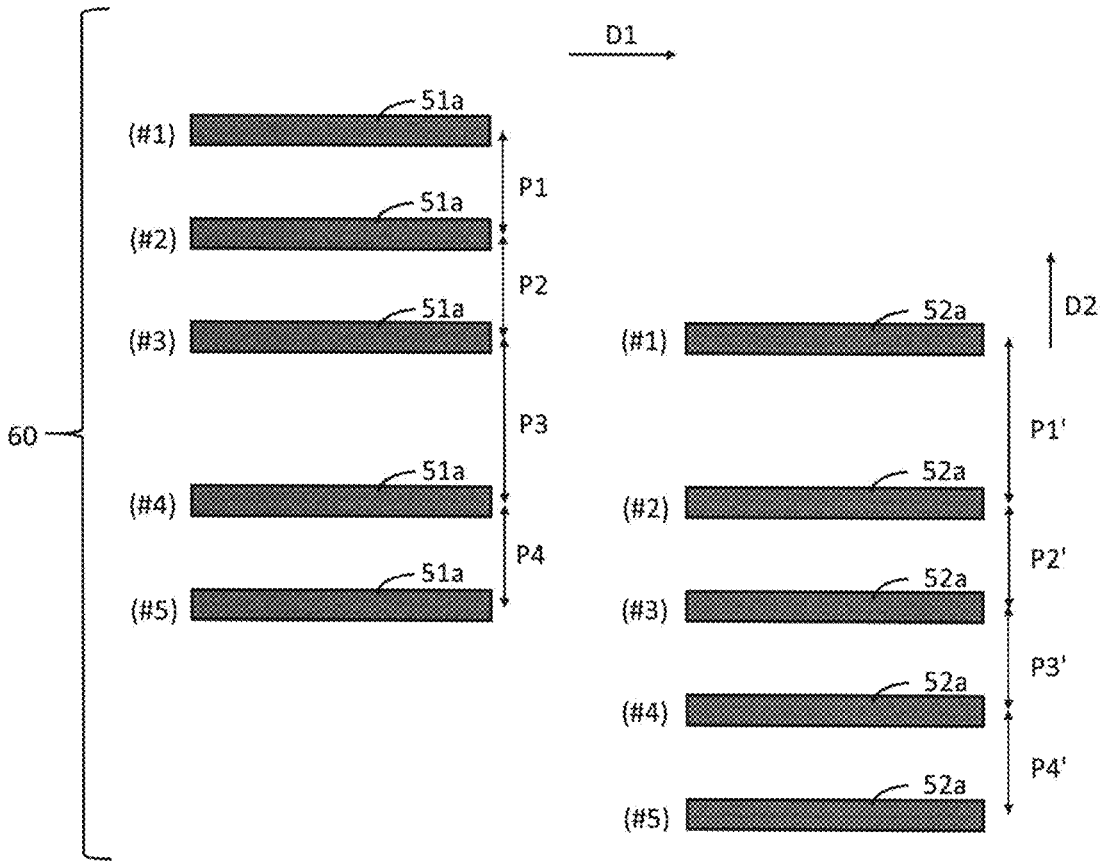
FIG. 7 illustrates a portion of read image data.

FIG. 7 illustrates a portion of the read image data 60 acquired at step S200. In FIG. 7, a portion of a reading result of the TP of a given color is represented. Specifically, a reference sign 51*a* and a reference sign 52*a* are images as the reading result of the pattern elements printed on the printing medium 30, and these are referred to as the pattern element images 51*a* and 52*a*. For example, the plurality of pattern element images 51*a* are the reading result of the plurality of pattern elements 51C configuring the first pattern element group 41C illustrated in FIG. 5, and the plurality of pattern element images 52*a* are the reading result of the plurality of pattern elements 52C configuring the second pattern element group 42C.

The inspection unit 12*c* detects the sudden deviation by evaluating differences between the plurality of pattern element images 51*a*, which are the images of the first pattern element group in the read image data 60, and the plurality of pattern element images 52*a*, which are the images of the second pattern element group in the read image data 60.

Specific examples of methods for detecting the sudden deviation are described below.

The inspection unit 12*c* determines a deviation amount ΔP(n) and a deviation amount ΔP(n−N) as follows.

$$\Delta P(n)=P(n)-P(n)'$$

$$\Delta P(n-N)=P(n-N)-P(n-N)'$$

The deviation amount ΔP(n) and the deviation amount ΔP(n−N) correspond to differences between the pattern element image 51*a* and the pattern element image 52*a*.

In each expression, n is an integer of 1 or greater. P(n) is an n-th "pattern element pitch" as counted from downstream in the reading result of the first pattern element group. The pattern element pitch in the reading result of the first pattern element group is the interval between the pattern element images 51*a* in the transfer direction D2. In FIG. 7, each of the pattern element images 51*a* and 52*a* is assigned with the nozzle number in brackets. This indicates, for each of the pattern element images 51*a* and 52*a*, with which of the nozzles 21 the read pattern elements have been printed. In the embodiment, for the first pattern element group, the interval between the pattern element image 51*a* of the pattern element printed by the nozzle 21 having the nozzle number #n and the pattern element image 51*a* of the pattern element printed by the nozzle 21 having the nozzle number #n+1 is P(n). Thus, for example, the interval between the pattern element image 51*a* of the pattern element 51C printed by the nozzle 21 having the nozzle number #3 and the pattern element image 51*a* of the pattern element 51C printed by the nozzle 21 having the nozzle number #4 is the pattern element pitch P3. FIG. 7 illustrates pattern element pitches P1, P2, P3, and P4.

P(n)' is the n-th pattern element pitch, as counted from downstream in the reading result of the second pattern element group. The pattern element pitch in the reading result of the second pattern element group is the interval between the pattern element images 52*a* in the transfer direction D2. In the embodiment, for the second pattern element group, the interval between the pattern element image 52*a* of the pattern element printed by the nozzle 21 having the nozzle number #n and the pattern element image 52*a* of the pattern element printed by the nozzle 21 having the nozzle number #n+1 is P(n)'. For example, the interval between the pattern element image 52*a* of the pattern element 52C printed by the nozzle 21 having the nozzle number #3 and the pattern element image 52*a* of the pattern element 52C printed by the nozzle 21 having the nozzle number #4 is a pattern element pitch P3'. FIG. 7 illustrates pattern element pitches P1', P2', P3', and P4'.

The deviation amount ΔP(n) is the difference between the pattern element pitch P(n) and the pattern element pitch P(n)'.

Similarly, P(n−N) is the n−N-th pattern element pitch, as counted from downstream in the reading result of the first pattern element group. In addition, P(n−N)' is the n−N-th pattern element pitch, as counted from downstream in the reading result of the second pattern element group.

N is a numerical value corresponding to the predetermined shift amount employed at step S140. The unit of the predetermined shift amount is the nozzle pitch P, and, as described above, since the predetermined shift amount is the nozzle pitch P×2, here, N is 2.

Thus, the pattern element pitch P(n) and the pattern element pitch P(n−N)' have a positional relationship in which the positions thereof in the transport direction D2 are the same in the read image data 60, as with the pattern element pitch P3 and the pattern element pitch P1'.

The deviation amount ΔP(n−N) is the difference between the pattern element pitch P(n−N) and the pattern element pitch P(n−N)' in this way.

Since the pattern element pitch P(n) and the pattern element pitch P(n)' are the distances between the pattern elements printed by the same combination of two of the nozzles 21, ideally, that is, when there is no sudden deviation, the deviation amount ΔP(n) is zero. Similarly, since the pattern element pitch P(n−N) and the pattern element pitch P(n−N)' are the distances between pattern elements printed by the same combination of two of the nozzles 21, ideally, the deviation amount ΔP(n−N) is zero.

Further, since the pattern element pitch P(n) and the pattern element pitch P(n−N)' have the positional relationship in which the positions thereof in the transport direction D2 are the same, the pattern element pitch P(n) and the pattern element pitch P(n−N)' may include the same sudden deviation.

Thus, when all of following conditions 1 to 3 are satisfied, the inspection unit 12*c* determines that there has been the sudden deviation in the pattern element pitch P(n) and the pattern element pitch P(n−N)'.

Condition 1: The positive or negative sign of ΔP(n) is the opposite to the positive or negative sign of Δp(n−N).

Condition 2: The absolute value of ΔP(n)+ΔP(n−N) is less than a predetermined first threshold value.

Condition 3: The absolute value of ΔP(n), and the absolute value of ΔP(n−N) are both greater than a predetermined second threshold value. Note that the first threshold value is smaller than the second threshold value.

For example, when focusing on a case in which n is 3, the sign of ΔP3=P3−P3' is positive and the sign of ΔP1=P1−P1' is negative, so Condition 1 is satisfied. Furthermore, if the absolute value of (P3−P3')+(P1−P1') is smaller than the first threshold value and the absolute value of (P3−P3') and the absolute value of (P1−P1') are both greater than the second threshold value, Condition 2 and Condition 3 are also satisfied. When n is 3 and the conditions 1 to 3 are satisfied in this way, the inspection unit 12*c* determines that there has been the sudden deviation in the pattern element pitch P3 and the pattern element pitch P1'.

Referring to FIG. 5 and FIG. 7, after the pattern element 51C printed by the nozzle 21 having the nozzle number #3 and the pattern element 52C printed by the nozzle 21 having the nozzle number #1 have been read at the same time, a greater amount of time is required than a normally required amount of time until reading the pattern element 51C printed by the nozzle 21 having the nozzle number #4 and the pattern element 52C printed by the nozzle 21 having the nozzle number #2. Thus, the pattern element pitch P3 and the pattern element pitch P1' that are a portion of the read image data 60 become elongated in the transport direction D2. This type of elongation is a type of the sudden deviation.

At step S400, the inspection unit 12*c* inspects a state of the ink discharge by the nozzles 21 of the printing head 18, based on the read image data acquired at step S200 and a detection result of the sudden deviation at step S300. The state of the ink discharge is divided into normal and abnormal. Abnormal applies to a discharge failure, such as a landing position deviation in which the landing positions of the dots deviate from ideal landing positions, and the like. It is sufficient that the inspection unit 12*c* compare each of the pattern element pitches in the read image data with a predetermined reference value relating to the pattern element pitch, and determine the abnormality, for example, for the nozzle 21 associated with the printing in which the pattern element pitch is narrower or wider than the reference value. However, the inspection unit 12*c* excludes, from the inspection at step S400, the pattern element pitch for which it has been determined at step S300 that there is the sudden deviation.

For example, when the sudden deviation has been successfully detected for the pattern element pitch P3 and the pattern element pitch P1' as described above, in the inspection at step S400, the inspection unit 12*c* does not target the pattern element pitch P3 and the pattern element pitch P1', and the pattern element pitch P4 and pattern element pitch P2' that are adjacent to and upstream of the pattern element pitch P3 and pattern element pitch P1'. In the example illustrated in FIG. 7, the inspection unit 12*c* performs the inspection at step S400 on the basis of the pattern element pitches P1, P2, P3', and P4' in the read image data 60. In this way, it is possible to avoid inspecting whether or not the nozzle 21 is normal or abnormal on the basis of the pattern element pitch for which there is a high likelihood that the interval is not appropriate due to the sudden deviation, and thus avoid an erroneous determination of an abnormality for some of the nozzles 21. The inspection unit 12*c* stores the inspection results at step S400. The flowchart illustrated in FIG. 4 ends here.

4. Summary and Description of Effects

According to the embodiment as described above, the printing apparatus 10 is provided with the transport unit 16 that transports the printing medium 30 in the transport direction D2, the printing head 18 including the plurality of nozzles 21 that discharge the ink, and the control unit 11 that, by controlling the transport unit 16 and the printing head 18, causes the TP to be printed on the printing medium 30 for the inspection of the state of the ink discharge by the nozzles 21. The TP includes the first pattern element group 41C in which the plurality of pattern elements 51C printed by the nozzles 21 are arranged in the transport direction D2, and the second pattern element group 42C in which the plurality of pattern elements 52C printed by the nozzles 21 are arranged in the transport direction D2. Then, the control unit 11 causes the printing medium 30 on which the first pattern element group 41C is printed by the discharge of the ink by the nozzles 21 to be transported by the transport unit 16 by the predetermined shift amount in the transport direction D2, and then causes the second pattern element group 42C to be printed on the printing medium 30 by causing the plurality of nozzles 21 used in the printing of the first pattern element group 41C to discharge the ink.

The predetermined shift amount is the distance equal to or greater than the nozzle pitch P. According to such a configuration, the printing apparatus 10 can print the TP suitable for the detection of the sudden deviation. In other words, in the embodiment, using the same plurality of nozzles, the first pattern element group and the second pattern element group that are substantially the same image are printed while being shifted with respect to each other in the transport direction D2 by a distance equal to or greater than the nozzle pitch P. Thus, by comparing the pattern element pitch corresponding to the first pattern element group in the read image data of the TP with the pattern element pitch corresponding to the second pattern element group in the read image data of the TP, it is possible to appropriately detect where in the read image data the sudden deviation has occurred as a result of a malfunction when reading the TP. Then, by appropriately detecting the sudden deviation, it is possible to increase the accuracy of the inspection as to whether the nozzle 21 is normal or abnormal that is performed on the basis of the read image data of the TP.

As described above, by setting the predetermined shift amount to be the distance equal to or greater than the nozzle pitch P, in the read image data, differences due to the sudden deviation may occur in one of the pattern element pitches of the first pattern element group and one of the pattern element pitches of the second pattern element group, which should essentially be the same interval. In other words, the presence or absence of the sudden deviation can be determined by evaluating the deviation amount $\Delta P(n)$ and the deviation amount $\Delta P\ (n-N)$.

As a suitable example, the control unit 11 may cause the printing medium 30 on which the first pattern element group is printed to be transported by the transport unit 16 by a distance equal to or greater than twice the nozzle pitch P, and may then print the second pattern element group on the printing medium 30. In other words, as illustrated in FIG. 5 and the like, the predetermined shift amount may be the nozzle pitch $P\times2$.

When the predetermined shift amount is the distance equal to or greater than twice the nozzle pitch P, the inspection at step S400 can be performed appropriately for each of the nozzles 21 from the entire read image data, even when the pattern element pitch for which the sudden deviation has been detected and the pattern element pitch adjacent to and upstream of this pattern element pitch are not targeted in the inspection at step S400. In other words, according to the example illustrated in FIG. 7, even when the pattern element pitches P3 and P4 are not targeted in the inspection at step S400, by referring to the pattern element pitches P3' and P4' instead, the inspection can be performed for each of the nozzles 21 having the nozzle numbers #3 and #4.

When the printing medium 30 printed with the TP is transported by the transport unit 16, the printing medium 30 may be transported in a tilted posture with respect to the transport direction D2. When the printing medium 30 is tilted, the further a distance in the main scanning direction D1 between the first pattern element group and the second pattern element group, the more the positional relationship between the first pattern element group and the second pattern element group in the transport direction D2 deviates so as to exceed the predetermined shift amount, and it becomes difficult to detect the sudden deviation using the above-described method for detecting the sudden deviation. Thus, in the embodiment, as illustrated in FIG. 6 and the like, the first pattern element group and the second pattern element group configuring the TP may be disposed at adjacent positions in the main scanning direction D1. According to such a configuration, when the printing medium 30 printed with the TP is read in the tilted state, the positional relationship between the read image of the first pattern element group and the read image of the second pattern element group in the transport direction D2 is maintained to be substantially normal, and the sudden deviation can be detected.

According to the embodiment, the printing apparatus 10 may include the reading unit 19 configured to read the printing medium 30 printed with the TP, at a position downstream of the printing head 18 in the transport direction D2. Further, in the example illustrated in FIG. 6, the reading unit 19 includes the plurality of sensor chips including the image sensors for reading.

Then, the first pattern element group and the second pattern element group configuring the TP may be disposed at positions that are readable by the same sensor chip.

In the example illustrated in FIG. 6, the TP 40C formed by the first pattern element group 41C and the second pattern element group 42C is printed at a position, on the printing medium 30, that is read by a sensor chip 191. Further, in the example illustrated in FIG. 6, on the printing medium 30, the TP 40M is printed at a position that is read by a sensor chip 192, the TP 40Y is printed at a position that is read by a sensor chip 193, and the TP 40K is printed at a position that is read by a sensor chip 194. Since each of the sensor chips has unique output characteristics and there is a deviation in mutual installation positions thereof, there may be deviations in color or position between read values output by each of the sensor chips. As in the example illustrated in FIG. 6, since the first pattern element group and the second pattern element group configuring the TP are in the positional relationship of being read by the same sensor chip, various types of deviation caused by differences in the sensor chips do not occur in the read value of the first pattern element group and the read value of the second pattern element group, and accuracy of the detection of the sudden deviation based on the read value of the first pattern element group and the read value of the second pattern element group is improved.

The embodiment also discloses an invention of each of categories, such as a method other than the printing apparatus 10 and the printing system 10, and the program 12.

A printing method includes a printing step of printing, using the printing head 18 including the plurality of nozzles 21 configured to discharge the ink, the TP on the printing medium 30, the TP being used for inspecting the state of ink discharge by the plurality of nozzles 21. The TP includes the first pattern element group in which the plurality of pattern elements to be printed by the nozzles 21 are arranged in the transport direction D2 of the printing medium 30, and the second pattern element group in which the plurality of pattern elements to be printed by the nozzles 21 are arranged in the transport direction D2, In the printing step, after transporting, by the distance equal to or greater than the nozzle pitch, the printing medium 30 printed with the first pattern element group as a result of the plurality of nozzles 21 discharging the ink, the second pattern element group is printed on the printing medium 30 by the plurality of nozzles 21 used to print the first pattern element group discharging the ink, the nozzle pitch being the interval, in the transport direction, between the nozzles 21.

5. Other Embodiments

Other aspects included in the embodiment will be described.

Each of the pattern elements configuring the first test pattern element group of the TP need not necessarily all be in the same positions in the main scanning direction D1. Similarly, each of the pattern elements configuring the second pattern element group of the TP need not necessarily all be in the same positions in the main scanning direction D1. The pattern elements configuring the first pattern element group may be arranged to be shifted with respect to each other in the main scanning direction D1 such that the positions thereof in the main scanning direction D1 coincide at a predetermined number of cycles, and similarly, the pattern elements configuring the second pattern element group may be arranged to be shifted with respect to each other in the main scanning direction D1 such that the positions thereof in the main scanning direction D1 coincide in a cycle of a predetermined number of the pattern elements.

Figure 8:
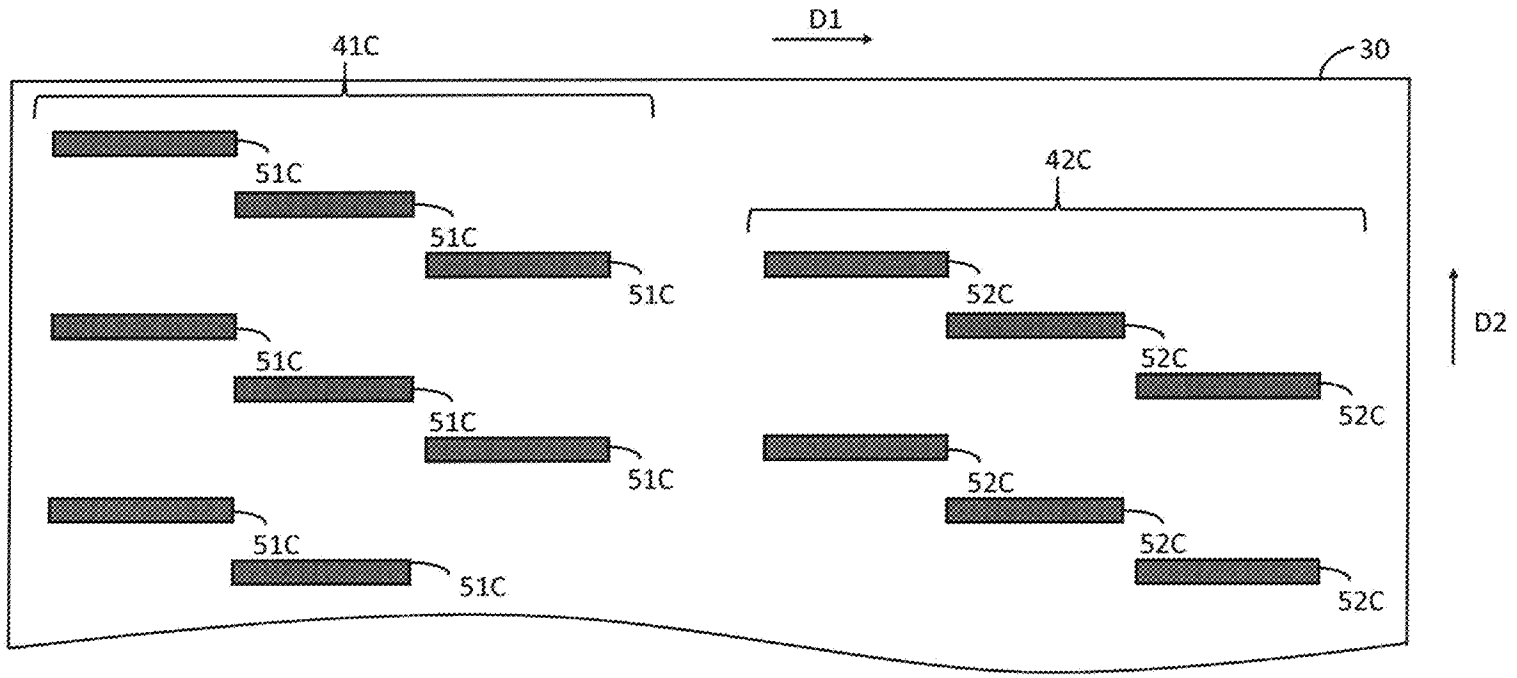
FIG. 8 illustrates the TPs according to another example.

FIG. 8 illustrates a portion of the TP printed on the printing medium 30. FIG. 8 illustrates a state in which the printing of the second pattern element group at step S150 has ended, as in the diagram on the right in FIG. 5. As described above, the first pattern element group 41C is configured by the plurality of pattern elements 51C with the interval therebetween in the transport direction D2 corresponding to the nozzle pitch P. The second pattern element group 42C, which is shifted by the predetermined shift amount in the transport direction D2 with respect to the first pattern element group 41C, is configured by the plurality of pattern elements 52C with the interval therebetween in the transport direction D2 corresponding to the nozzle pitch P. Further, according to FIG. 8, each of the pattern elements 51C is also disposed with a position thereof being shifted in the main scanning direction D1, such that the positions thereof in the main scanning direction D1 coincide every three cycles. In a similar manner, each of the pattern elements 52C is also disposed with a position thereof being shifted in the main scanning direction D1, such that the positions thereof in the main scanning direction D1 coincide every three cycles. In other words, FIG. 8 illustrates a case in which the predetermined number of cycles is 3. The predetermined number of cycles may be 2, or may be 4 or more. By printing the pattern elements to be shifted with respect to each other in the main scanning direction D1, when detecting the sudden unexpected shift based on the read image data and when inspecting the nozzles 21, the inspection unit 12*c* easily identifies each one of the pattern elements, and further, the user can also easily recognize each one of the pattern elements.

It goes without saying that the printing medium 30 need not necessarily be the continuous sheet wound into the roll, as exemplified in FIG. 2, or the like. The printing medium 30 may be a single sheet cut into page units, or the like.

When the sudden deviation is successfully detected at step S300, the control unit 11 may once more scan the TP printed at step S100, rather than performing the inspection at step S400. For example, when the control unit 11 successfully detects the sudden deviation at step S300, the control unit 11 causes the transport unit 16 to back feed the printing medium 30. The back feed is processing of transporting the printing medium 30 from downstream to upstream. Once the portion of the printing medium 30 on which the TP has been printed returns to a position upstream of the reading unit 19 as a result of the back feed, the control unit 11 once more starts transporting the printing medium 30 downstream, and causes the reading unit 19 to read the printing medium 30 printed with the TP. In this way, the control unit 11 can once more acquire the read image data (step S200) and execute step S300 on the basis of the read image data.

The TP may further include a third pattern element group in which a plurality of pattern elements printed by the nozzles 21 are arranged in the transport direction D2, and which are shifted by a predetermined shift amount in a direction opposite from the second pattern element group with respect to the first pattern element group. In other words, at step S100, the printing control unit 12*a* prints the TP on the printing medium 30 by performing the processing in the following order: printing the third pattern element group by a pass of the printing head 18, transporting the printing medium 30 by the predetermined shift amount, printing the first pattern element group, transporting the printing medium 30 by the predetermined shift amount, and printing the second pattern element group. The third pattern element group also is substantially the same image as the first pattern element group and the second pattern element group. In this case, assuming that the predetermined shift amount of is the nozzle pitch P×2, on the printing medium 30, positions of the pattern element, of the third pattern element group, printed by the nozzle 21 having the nozzle number #5, the pattern element, of the first pattern element group, printed by the nozzle 21 having the nozzle number #3, and the pattern element, of the second pattern element group, printed by the nozzle 21 having the nozzle number #1 coincide in the transport direction D2. Further, the third pattern element group, the first pattern element group, and the second pattern element group are arranged in this order in the main scanning direction D1.

According to such a configuration, in the read image data of the TP, positions of all of the pattern element pitches between the pattern element images 51*a* corresponding to the first pattern element group coincide, in the transport direction D2, with one of the pattern element pitches between the pattern element images 52*a* corresponding to the second pattern element group, and the pattern element pitches between pattern element images corresponding to the third pattern element group. Thus, at step S300, the inspection unit 12*c* can cause all of the pitches P1, P2, P3, and P4 corresponding to the first pattern element group to be targeted for the detection of the sudden deviation.

The arrangement of the reading unit 19 need not necessarily be downstream of the printing medium 30, and may be upstream of the printing medium 30.

The reading unit 19 need not necessarily be a fixed line scan type, and may be, for example, a mobile serial scan type in which the reading unit 19 performs the reading while moving in the main scanning direction D1.

Each of the pattern elements 51C need not necessarily be the ruled line and may be, for example, a point.

The second pattern element group need not necessarily be printed for all the ink colors, and the second pattern element group may be printed using only one of the ink colors, for example.

What is claimed is:

1. A printing apparatus comprising:

a transport unit configured to transport a printing medium in a transport direction;

a printing head including a plurality of nozzles configured to discharge ink; and a control unit configured to control the transport unit and the printing head to print, on the printing medium, a test pattern for inspecting a state of ink discharge by the nozzles, wherein the test pattern includes a first pattern element group in which a plurality of pattern elements to be printed by the nozzles are arranged in the transport direction, and a second pattern element group in which a plurality of pattern elements to be printed by the nozzles are arranged in the transport direction, the first pattern element group is separate and spaced apart from the second pattern element group in a main scanning direction intersecting the transport direction, and after the control unit causes the transport unit to transport, in the transport direction, by a distance that is equal to or greater than a nozzle pitch, the printing medium printed with the first pattern element group by causing the nozzles to discharge the ink, the control unit prints the second pattern element group on the printing medium by causing the nozzles, which have been used to print the first pattern element groups to discharge the ink, the nozzle pitch being an interval, in the transport direction, between the nozzles, wherein the pattern elements of the first pattern element group configure a predetermined number of first element sets each of which has at least two of the pattern elements aligned with respect to each other in the transport direction, the first element sets are shifted in the main scanning direction relative to each other and the pattern elements of the second pattern element group configure a predetermined number of second element sets each of which has at least two of the pattern elements aligned with respect to each other in the transport direction, the second element sets are shifted in the main scanning direction relative to each other.

2. The printing apparatus according to claim 1, wherein after the control unit causes the transport unit to transport, in the transport direction, the printing medium printed with the first pattern element group by the distance that is equal to or greater than twice the nozzle pitch, the control unit prints the second pattern element group on the printing medium.

3. The printing apparatus according to claim 1, wherein the first pattern element group and the second pattern element group are disposed at adjacent positions in the main scanning direction.

4. The printing apparatus according to claim 1, comprising:

at a position downstream of the printing head in the transport direction, a reading unit configured to read the printing medium printed with the test pattern, wherein the reading unit includes a plurality of sensor chips including an image sensor for reading, and the first pattern element group and the second pattern element group are disposed in positions readable by the same sensor chip.

5. A printing method comprising:

a printing step of printing, using a printing head including a plurality of nozzles configured to discharge ink, a test pattern on a printing medium, the test pattern being used for inspecting a state of ink discharge by the nozzles, wherein the test pattern includes a first pattern element group in which a plurality of pattern elements to be printed by the nozzles are arranged in a transport direction of the printing medium, and a second pattern element group in which a plurality of pattern elements to be printed by the nozzles are arranged in the transport direction, the first pattern element group is separate and spaced apart from the second pattern element group in a main scanning direction intersecting the transport direction, and the printing step includes, after transporting, in the transport direction, by a distance that is equal to or greater than a nozzle pitch, the printing medium printed with the first pattern element group by causing the plurality of nozzles to discharge the ink, printing the second pattern element group on the printing medium by causing the plurality of nozzles, which have been used to print the first pattern element group to discharge the ink, the nozzle pitch being an interval, in the transport direction, between the nozzles, wherein the pattern elements of the first pattern element group configure a predetermined number of first element sets each of which has at least two of the pattern elements aligned with respect to each other in the transport direction, the first element sets are shifted in the main scanning direction relative to each other and the pattern elements of the second pattern element group configure a predetermined number of second element sets each of which has at least two of the pattern elements aligned with respect to each other in the transport direction, the second element sets are shifted in the main scanning direction relative to each other.

* * * * *